US008919508B1

(12) United States Patent
Halko et al.

(10) Patent No.: US 8,919,508 B1
(45) Date of Patent: Dec. 30, 2014

(54) PORTABLE SUITCASE TABLETOP SYSTEM

(71) Applicants: Monica E. Halko, Granada Hills, CA (US); Karen Heitz, Redondo Beach, CA (US)

(72) Inventors: Monica E. Halko, Granada Hills, CA (US); Karen Heitz, Redondo Beach, CA (US)

( * ) Notice: Subject to any disclaimer, the term of this patent is extended or adjusted under 35 U.S.C. 154(b) by 0 days.

(21) Appl. No.: 14/096,998

(22) Filed: Dec. 4, 2013

Related U.S. Application Data

(63) Continuation-in-part of application No. 13/568,971, filed on Aug. 7, 2012, now Pat. No. 8,613,349.

(51) Int. Cl.
*A45C 9/00* (2006.01)
*A45C 5/03* (2006.01)

(52) U.S. Cl.
CPC .... *A45C 9/00* (2013.01); *A45C 5/03* (2013.01)
USPC ..... 190/11; 190/8; 190/18 A; 108/42; 108/47; 206/320; 224/155; 280/37; 280/47.18

(58) Field of Classification Search
USPC ..... 190/11, 8, 18 A; 108/42, 47; 206/320; 224/155; 280/37, 47.18
See application file for complete search history.

(56) References Cited

U.S. PATENT DOCUMENTS

| | | | | |
|---|---|---|---|---|
| 3,557,916 | A | 1/1971 | Stowell | |
| 5,374,073 | A * | 12/1994 | Hung-Hsin | 280/30 |
| 5,437,367 | A | 8/1995 | Martin | |
| D403,899 | S | 1/1999 | Paparo, Jr. | |
| 5,941,352 | A * | 8/1999 | Lee | 190/11 |
| 5,957,349 | A * | 9/1999 | Krulik | 224/155 |
| 6,105,508 | A | 8/2000 | Ryburg | |
| D459,883 | S * | 7/2002 | Worrell et al. | D3/274 |
| 6,471,019 | B1 * | 10/2002 | Miller | 190/11 |
| 6,644,447 | B2 * | 11/2003 | Pohl | 190/8 |
| 6,932,427 | B2 | 8/2005 | Tamura | |
| 7,114,602 | B2 | 10/2006 | Chen | |
| 7,213,692 | B2 * | 5/2007 | Wang et al. | 190/8 |
| 8,146,722 | B1 | 4/2012 | Moreno et al. | |
| 8,613,349 | B1 * | 12/2013 | Halko et al. | 190/11 |
| 2005/0098402 | A1 * | 5/2005 | Cohen | 190/12 A |
| 2005/0194226 | A1 | 9/2005 | Wang et al. | |
| 2007/0089952 | A1 | 4/2007 | Herbst et al. | |
| 2008/0217129 | A1 | 9/2008 | Whelan | |
| 2009/0255771 | A1 * | 10/2009 | Puchalski | 190/18 A |
| 2010/0236884 | A1 | 9/2010 | Brown | |
| 2011/0056788 | A1 | 3/2011 | Jackson | |

* cited by examiner

*Primary Examiner* — Fenn Mathew
*Assistant Examiner* — Cynthia Collado

(57) ABSTRACT

A portable suitcase tabletop system features a suitcase with a u-shaped telescopic handle located on a suitcase top surface. The telescopic handle slides out and away from the suitcase top surface when extended. The suitcase features a plurality of wheels located on a suitcase bottom surface. The system features a planar table pivotally located on a suitcase rear surface or a suitcase front surface. A U-shaped bar is slides out from the suitcase rear surface or the suitcase front surface next to a table bottom surface. The bar supports the table. The table and the bar are located in a zippered pouch. A telescopic front support slides out from a front support cavity located in the suitcase rear surface or the suitcase front surface close to the suitcase bottom surface.

5 Claims, 19 Drawing Sheets

PORTABLE SUITCASE TABLETOP SYSTEM

CROSS REFERENCE

This application claims priority to U.S. patent application Ser. No. 13/568,971, filed Aug. 7, 2012, the specification of which is incorporated herein in its entirety by reference.

FIELD OF THE INVENTION

The present invention relates to luggage and luggage with a collapsible table incorporated therein.

BACKGROUND OF THE INVENTION

Traditionally, luggage such as carryon bags, duffle bags, trunks, totes and suitcases have been used to carry clothing or other personal items when traveling. Because a traveler, along with his luggage, often spends time waiting for a connecting flight, a bus, or a taxi, a need exists for a work, writing, or a reading surface during this waiting time. The present invention features a portable suitcase tabletop system.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a portable suitcase tabletop system. In some embodiments, the system comprises a suitcase. In some embodiments, the suitcase comprises a generally u-shaped telescopic handle located on a suitcase top surface. In some embodiments, the telescopic handle slidably projects out and away from the suitcase top surface when extended. In some embodiments, the suitcase comprises a plurality of wheels located on a suitcase bottom surface.

In some embodiments, the system comprises a planar table. In some embodiments, the table is pivotally located on a suitcase rear surface or a suitcase front surface. In some embodiments, in a first closed position, the table is located parallel with and pivoted against the suitcase rear surface or the suitcase front surface. In some embodiments, in a second open position, the table is pivoted into a position parallel with the suitcase top surface.

In some embodiments, a U-shaped bar is telescopically located on the suitcase rear surface or the suitcase front surface next to a table bottom surface. In some embodiments, upon retraction, the bar supports the table via interfacing with the table bottom surface. In some embodiments, the bar extends from the suitcase. In some embodiments, the bar retracts into the suitcase. In some embodiments, the table and the bar are located in a zippered pouch located on the suitcase rear surface or the suitcase front surface.

In some embodiments, a telescopic front support is slidably located in a front support cavity. In some embodiments, the front support cavity is located in the suitcase rear surface or the suitcase front surface close to the suitcase bottom surface. In some embodiments, in a first retracted position, the front support is fully retracted into the front support cavity. In some embodiments, in a second extended position, the front support is extended from the front support cavity.

DESCRIPTION OF PREFERRED EMBODIMENTS

Figure 1:
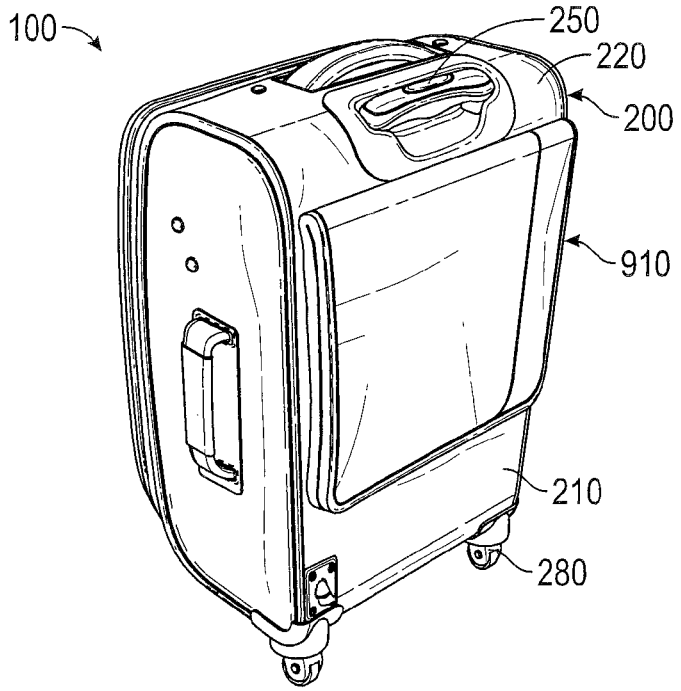
FIG. 1 shows a perspective view of the present invention.

Following is a list of elements corresponding to a particular element referred to herein:

100 Portable suitcase tabletop system
200 Suitcase
210 Suitcase rear surface
220 Suitcase top surface
230 Suitcase bottom surface
240 Suitcase front surface
250 Telescopic handle
252 First handle rod
254 Second handle rod
256 Top handle rod
260 First handle tube
270 Second handle tube
280 Wheel
300 Table
302 Table top surface
304 Table bottom surface

306 Table edge
310 Table mount
312 First table mount rod
314 Second table mount rod
316 Top table mount rod
322 First table mount tube
324 Second table mount tube
330 Horizontal support mount bar
332 Support mount bar first end
334 Support mount bar second end
340 First foldable locking support
342 First locking support first end
344 First locking support second end
350 Second foldable locking support
352 Second locking support first end
354 Second locking support second end
360 Slot
362 Side edge
364 Spring loaded pin
366 Aperture
400 Front support
405 Front support angle
410 Front support cavity
420 Front support edge
500 Rear support
510 Rear support cavity
520 Rear support edge
600 Storage compartment
700 Cup aperture
810 First table panel
812 Table first side
820 Second table panel
822 Table second side
900 Bar
901 First bar leg
902 Second bar leg
903 Bar middle leg
904 Bar cavity
905 Bar angle
910 Pouch

Preferred Embodiment

Figure 2:
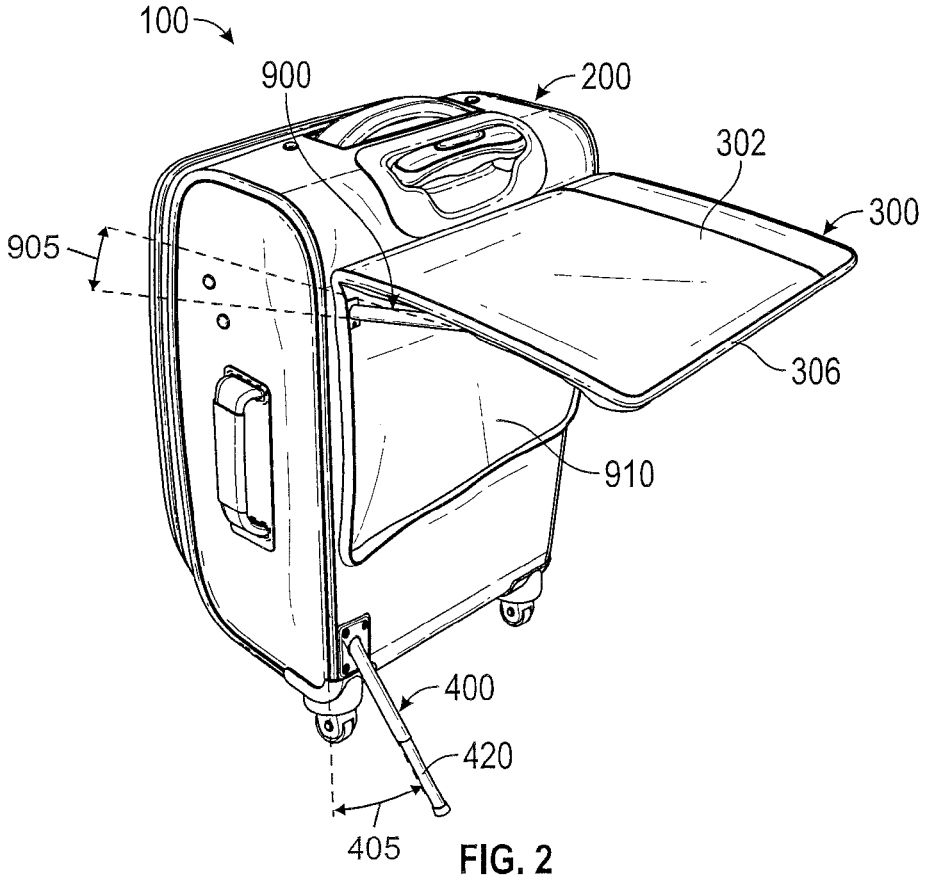
FIG. 2 shows a perspective view of the present invention.
Figure 3:
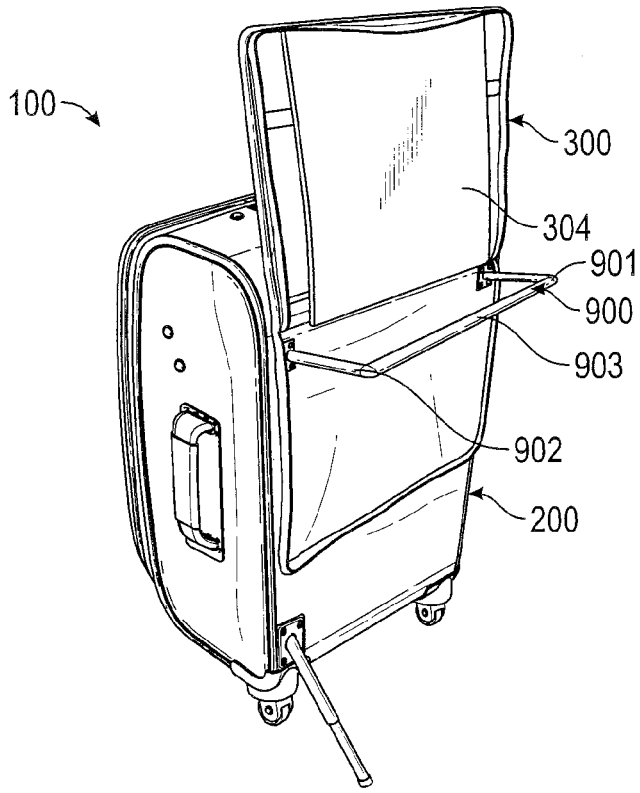
FIG. 3 shows a perspective view of the present invention.
Figure 4:
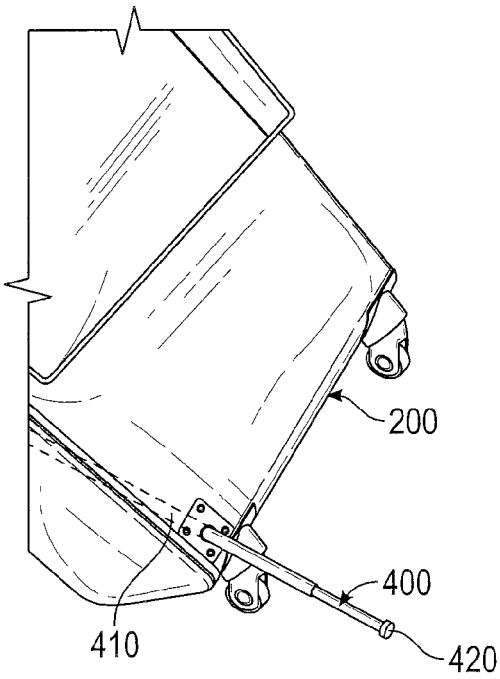
FIG. 4 shows a close-up view of the present invention featuring a telescopic front support.
Figure 5:
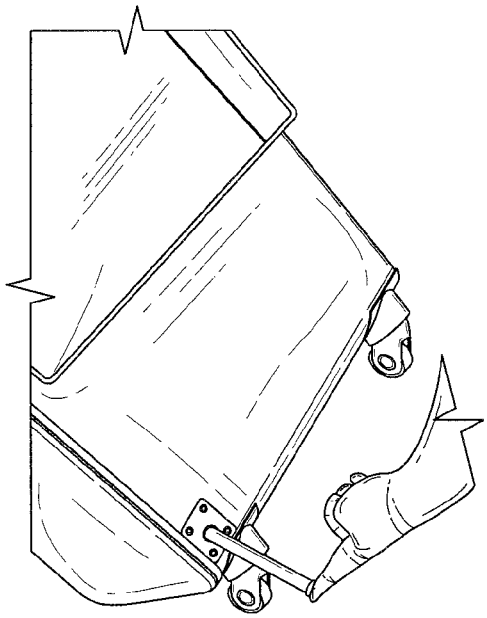
FIG. 5 shows a close-up view of the present invention featuring a telescopic front support.
Figure 6:
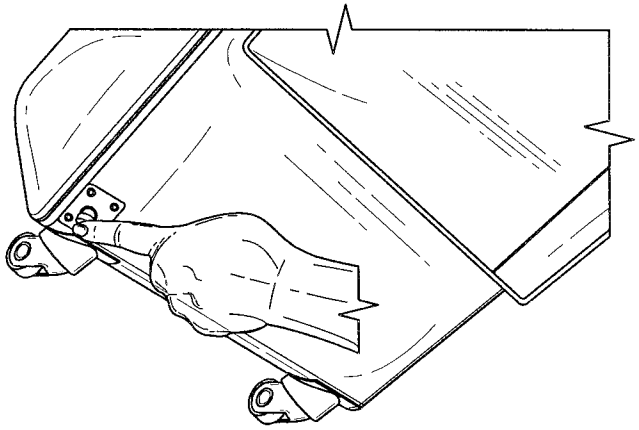
FIG. 6 shows a close-up view of the present invention featuring a telescopic front support.
Figure 7:
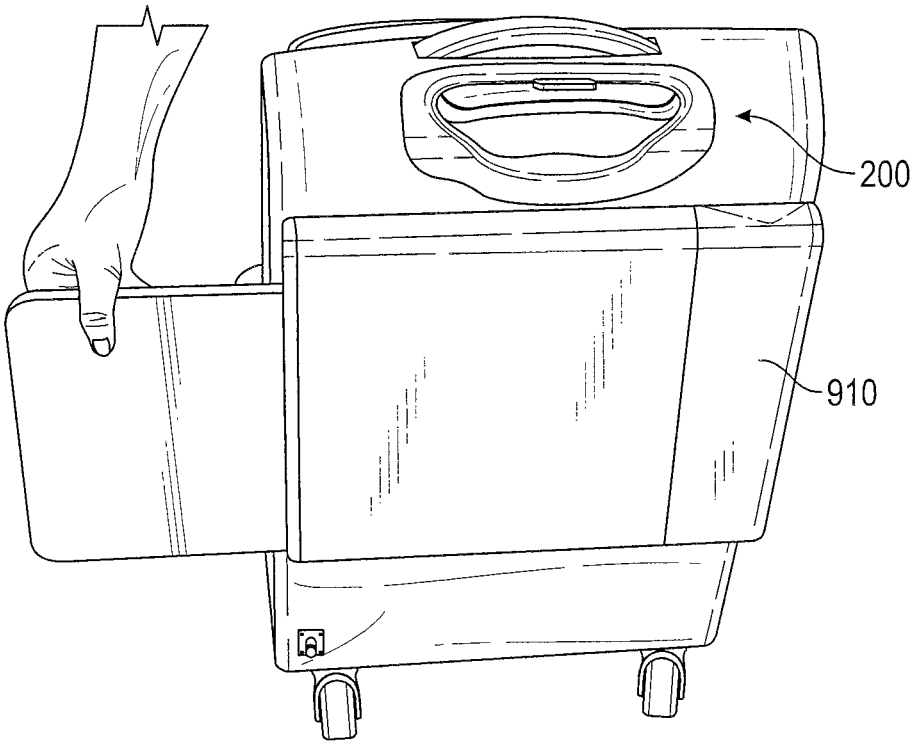
FIG. 7 shows a close-up view of the present invention featuring a zippered pouch.
Figure 8:
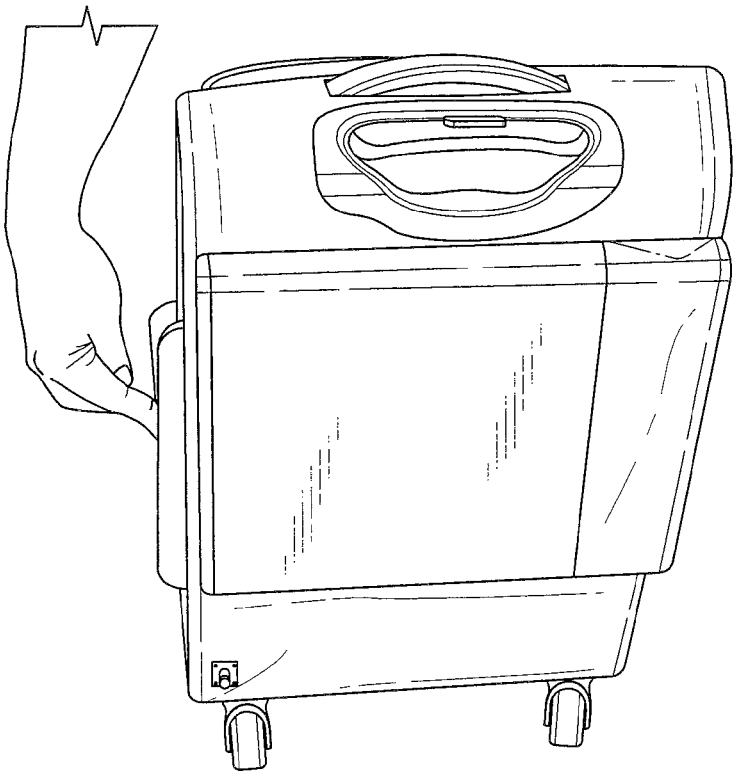
FIG. 8 shows a close-up view of the present invention featuring a zippered pouch.
Figure 9:
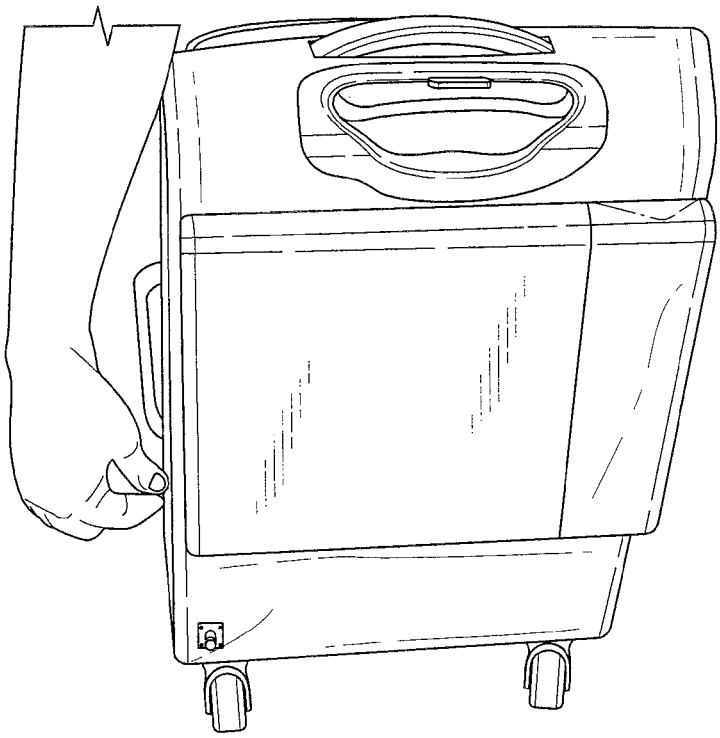
FIG. 9 shows a close-up view of the present invention featuring a zippered pouch.
Figure 10:
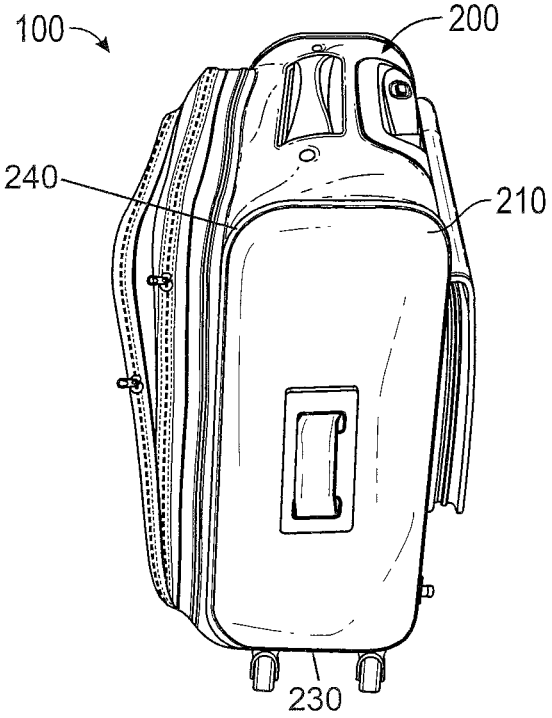
FIG. 10 shows a side view of the present invention.
Figure 11:
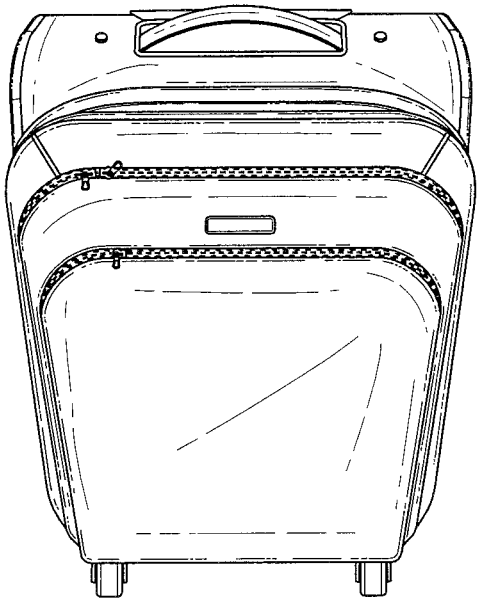
FIG. 11 shows a front view of the present invention.
Figure 12:
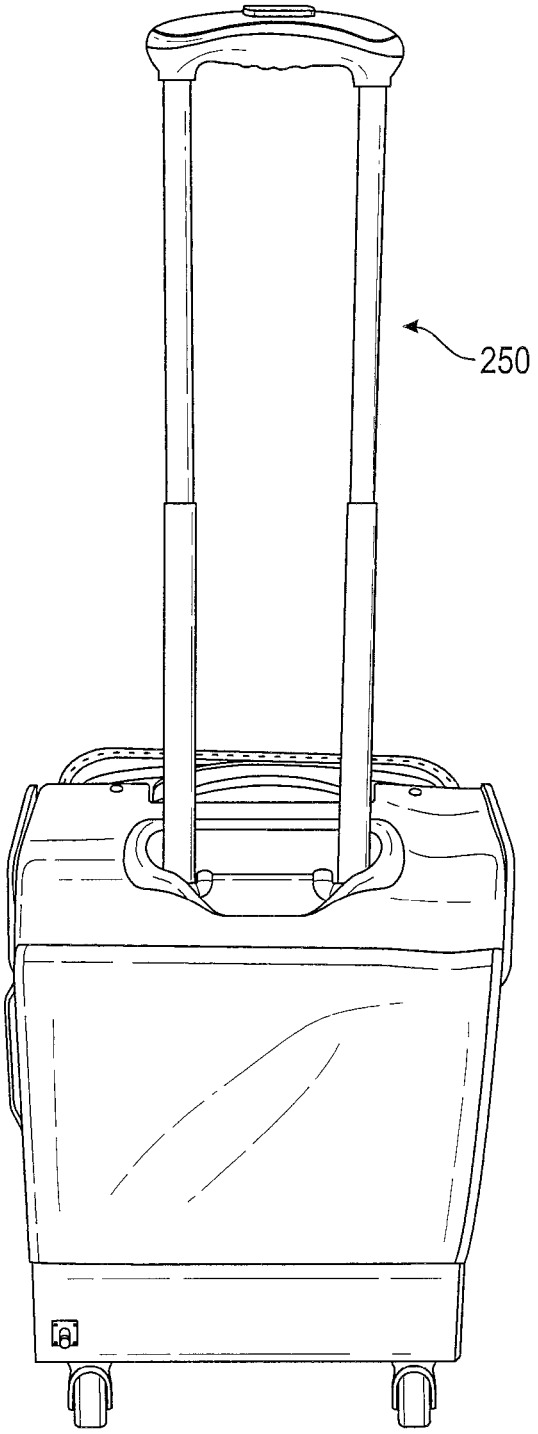
FIG. 12 shows a front view of the present invention featuring a telescopic handle.
Figure 13:
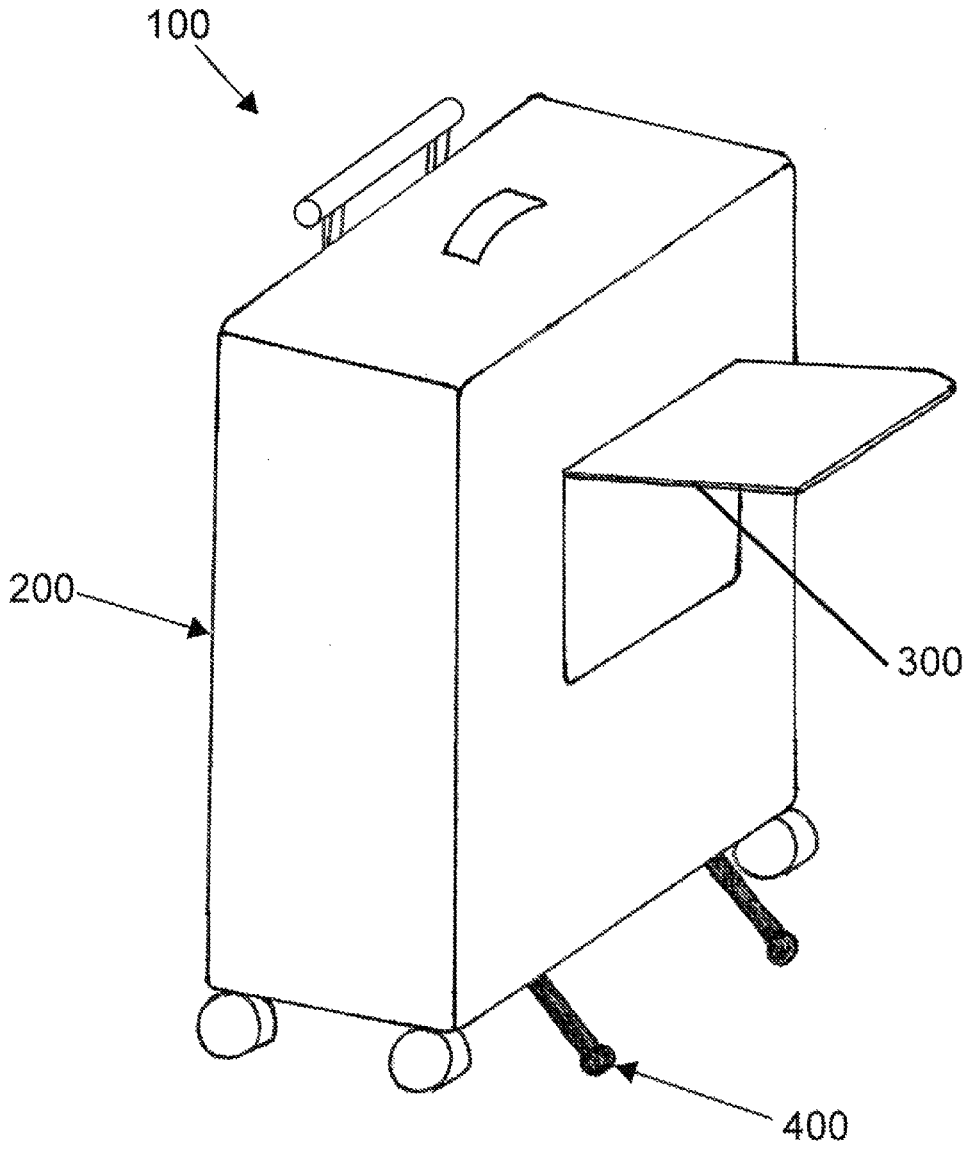
FIG. 13 shows a perspective view of the present invention.
Figure 14:
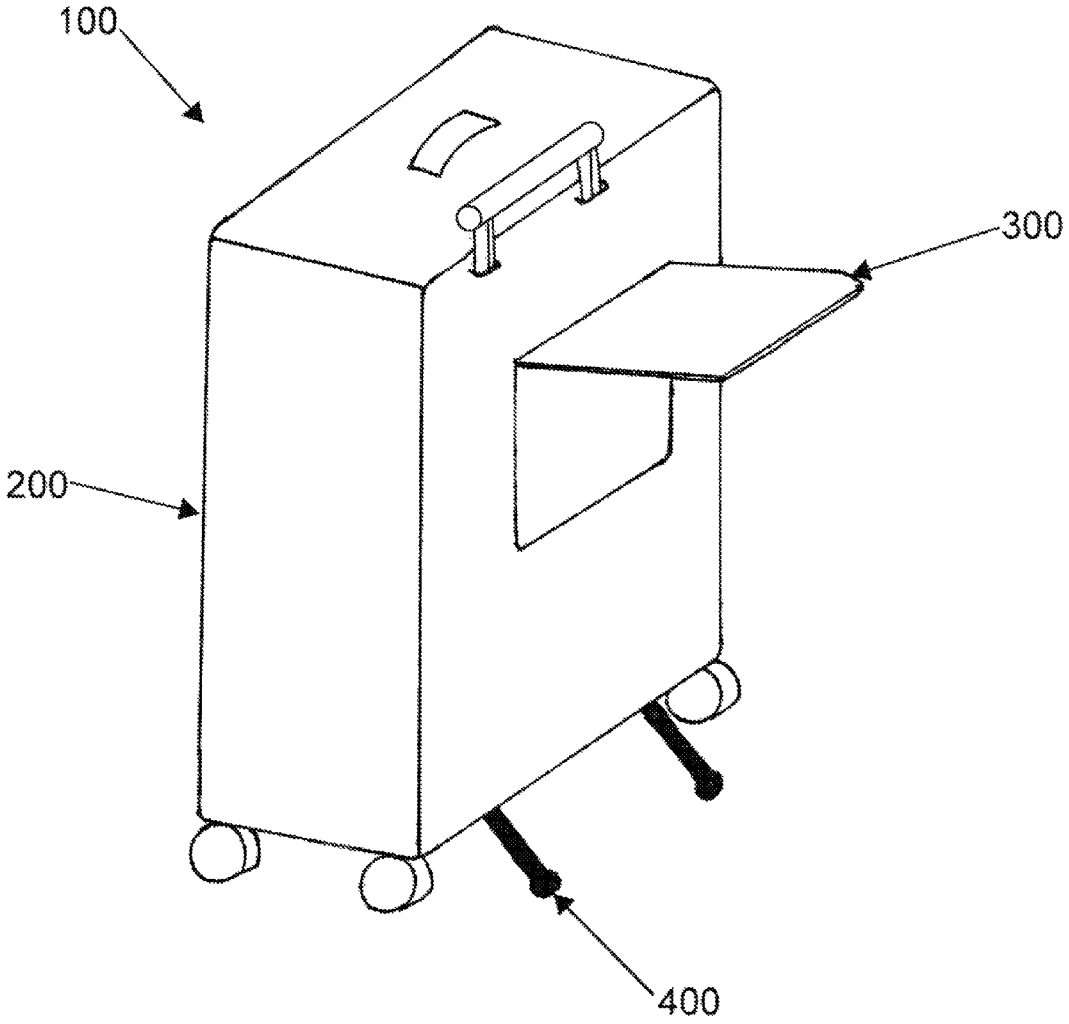
FIG. 14 shows a perspective view of the present invention.
Figure 15:
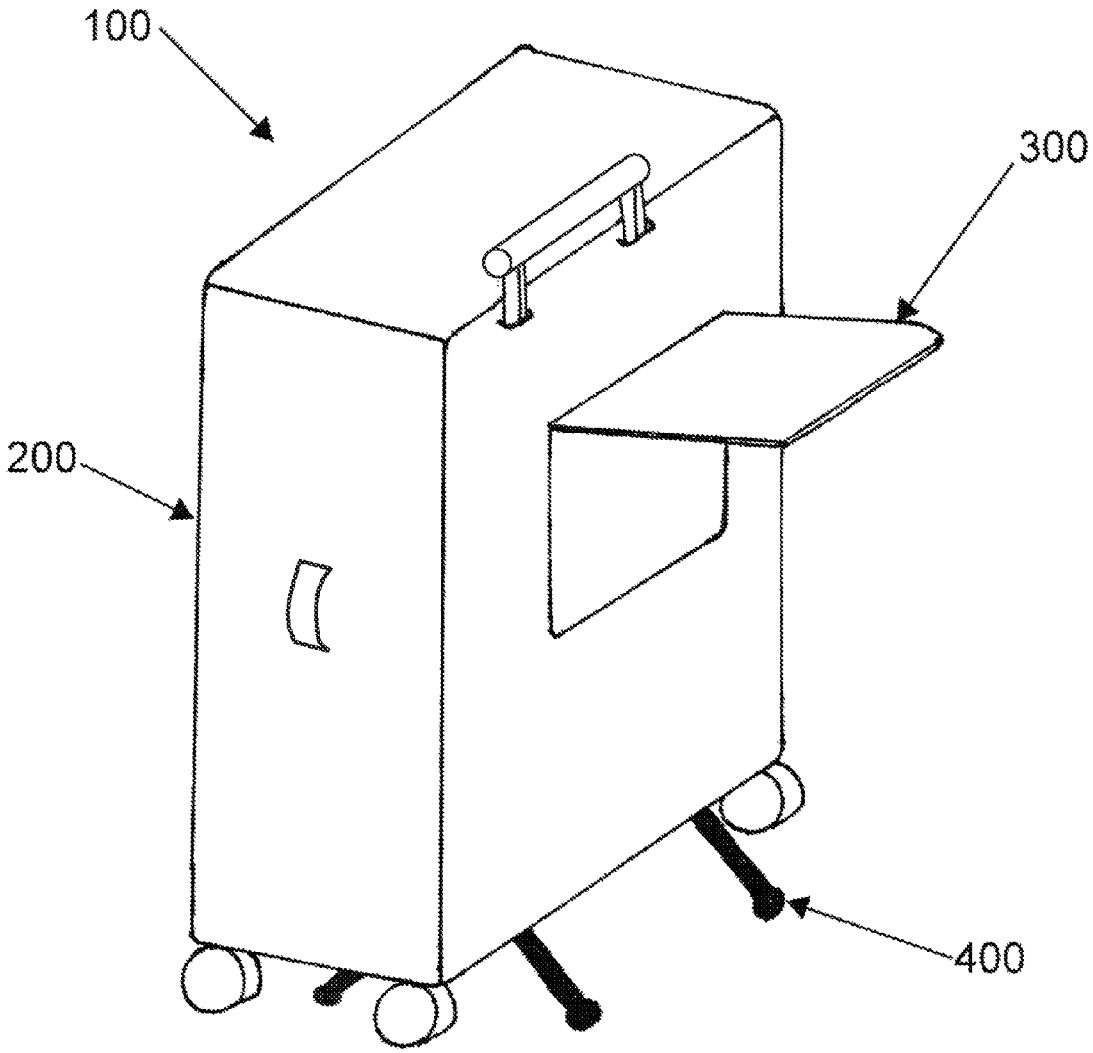
FIG. 15 shows a perspective view of an alternate embodiment of the present invention.

Referring now to FIG. 1-15, the present invention features a portable suitcase tabletop system (100). In some embodiments, the said system (100) comprises a suitcase (200) having a suitcase rear surface (210), a suitcase top surface (220), a suitcase bottom surface (230), and a suitcase front surface (240). In some embodiments, the suitcase (200) comprises a generally u-shaped telescopic handle (250) located on the suitcase top surface (220). In some embodiments, the telescopic handle (250) slidably projects out and away from the suitcase top surface (220) when extended. In some embodiments, the suitcase (200) comprises a plurality of wheels (280) located on the suitcase bottom surface (230).

In some embodiments, the system (100) comprises a planar table (300) having a table top surface (302), a table bottom surface (304), and a table edge (306). In some embodiments, the table (300) is pivotally located on the suitcase rear surface (210) or the suitcase front surface (240).

In some embodiments, in a first closed position, the table (300) is located parallel with and pivoted against the suitcase rear surface (210) or the suitcase front surface (240). In some embodiments, in a second open position, the table (300) is pivoted into a position parallel with the suitcase top surface (220).

In some embodiments, a U-shaped bar (900) is telescopically located on the suitcase rear surface (210) or the suitcase front surface (240) next to the table bottom surface (304). In some embodiments, upon retraction, the bar (900) supports the table (300) via interfacing with the table bottom surface (304). In some embodiments, the bar (900) extends from the suitcase (200) a distance not greater than a distance from the suitcase rear surface (210) to the suitcase front surface (240). In some embodiments, the bar (900) extends out and away from the suitcase rear surface (210) or the suitcase front surface (240) at a bar angle (905). In some embodiments, the bar (900) retracts into the suitcase (200). In some embodiments, a first bar leg (901) and a second bar leg (902) project into a bar cavity (904) located inside the suitcase (200) so as not to contact the contents of the suitcase. In some embodiments, a bar middle leg (903) remains outside the suitcase (200).

In some embodiments, the bar angle (905) is 15 degrees. In some embodiments, the bar angle (905) is 30 degrees. In some embodiments, the bar angle (905) is 45 degrees. In some embodiments, the bar angle (905) is 60 degrees. In some embodiments, the bar angle (905) is 75 degrees. In some embodiments, the bar angle (905) is 90 degrees.

In some embodiments, the table (300) and the bar (900) are located in a zippered pouch (910) located on the suitcase rear surface (210) or the suitcase front surface (240). In some embodiments, the zippered pouch (910) is adapted to hold one or more additional objects therein not limited to a personal tablet computer. In some embodiments, an exterior surface of the zippered pouch (910) is the table top surface (302).

In some embodiments, a telescopic front support (400) is slidably located in a front support cavity (410). In some embodiments, the front support cavity (410) is located in the suitcase rear surface (210) or the suitcase front surface (240) close to the suitcase bottom surface (230). In some embodiments, in a first retracted position, the front support (400) is fully retracted into the front support cavity (410). In some embodiments, in a second extended position, the front support (400) is extended from the front support cavity (410) at a front support angle (405). In some embodiments, the front support (400) locks into the second position, having an front support edge (420) that interfaces with a ground surface. In some embodiments, the front support (400) is for stabilizing the suitcase (200).

In some embodiments, the front support angle (405) is 15 degrees. In some embodiments, the front support angle (405) is 30 degrees. In some embodiments, the front support angle (405) is 45 degrees. In some embodiments, the front support angle (405) is 60 degrees. In some embodiments, the front support angle (405) is 75 degrees.

In some embodiments, the system comprises a plurality of telescopic front supports (400) or telescopic rear supports (500) located on the suitcase rear surface (210).

In some embodiments, the system comprises a plurality of telescopic front supports (400) located on the suitcase front surface (240).

In some embodiments, the system comprises a telescopic front support (400) located on the suitcase front surface (240) and a telescopic rear support (500) located on the suitcase rear surface (210).

In some embodiments, the system (100) comprises a first table (300) located on the suitcase rear surface (210) and a second table (300) located on the suitcase front surface (240).

Alternate Embodiment

Figure 16:
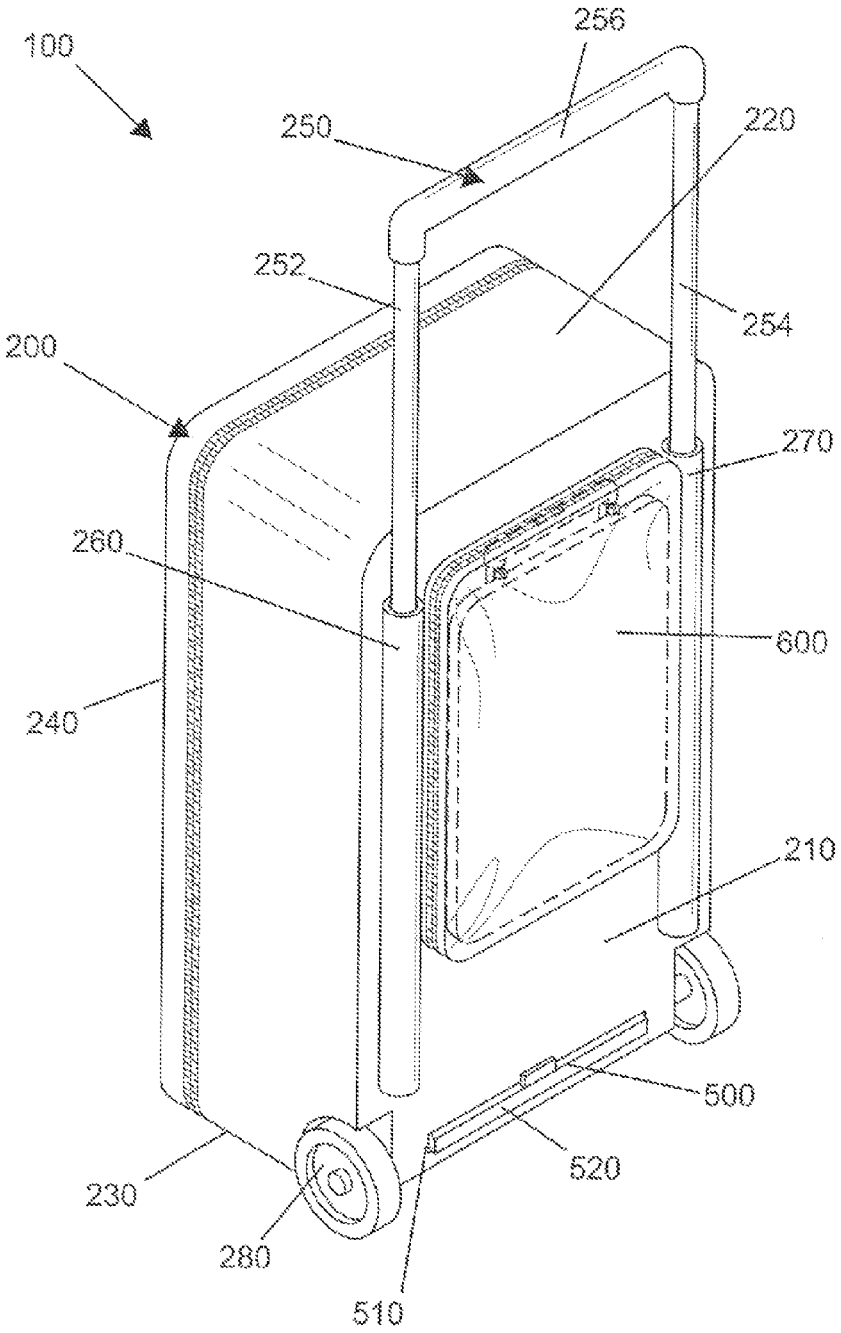
FIG. 16 shows a rear perspective view of an alternate embodiment of the present invention.
Figure 17:
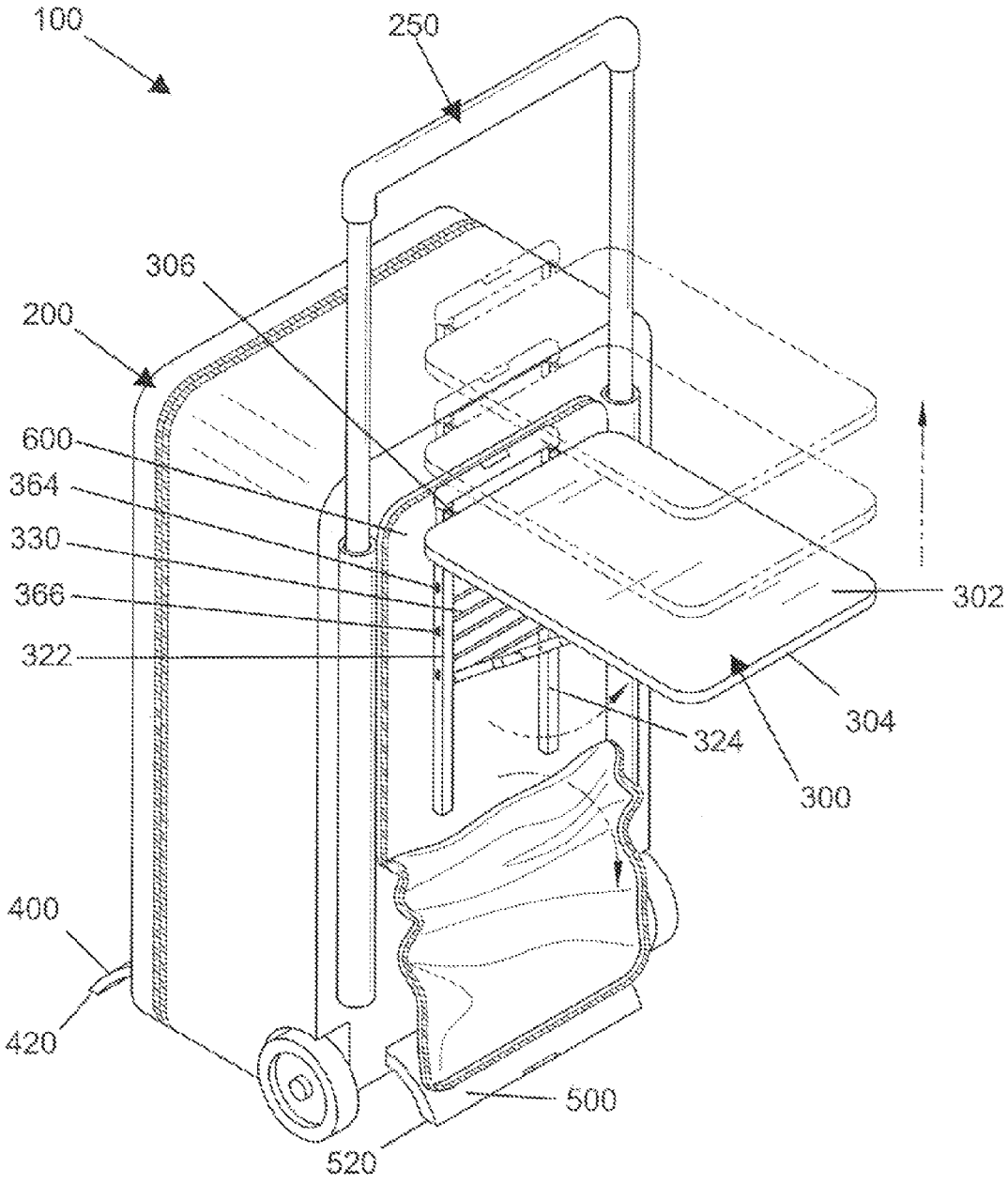
FIG. 17 shows a rear perspective view of an alternate embodiment of the present invention.
Figure 18:
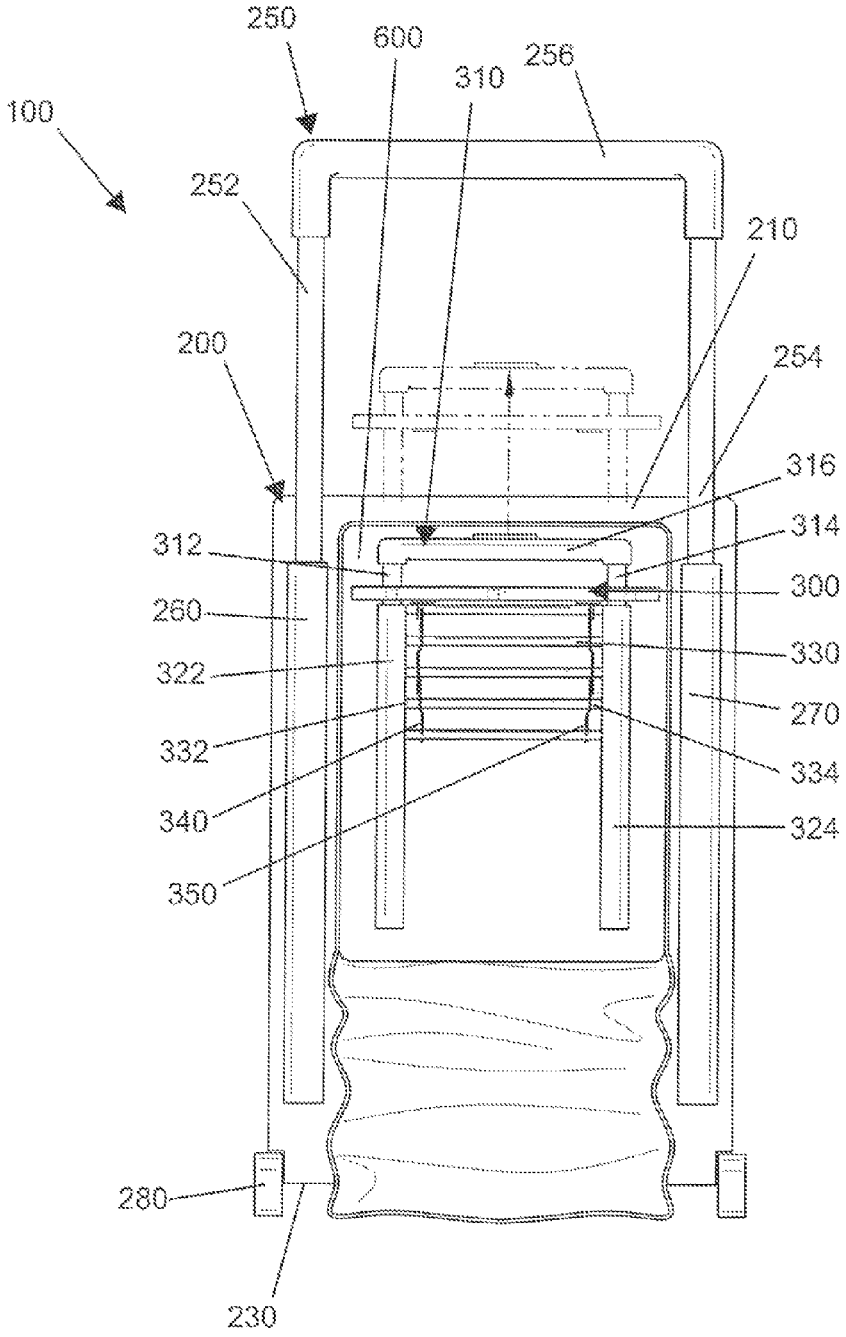
FIG. 18 shows a rear view of an alternate embodiment of the present invention.
Figure 19:
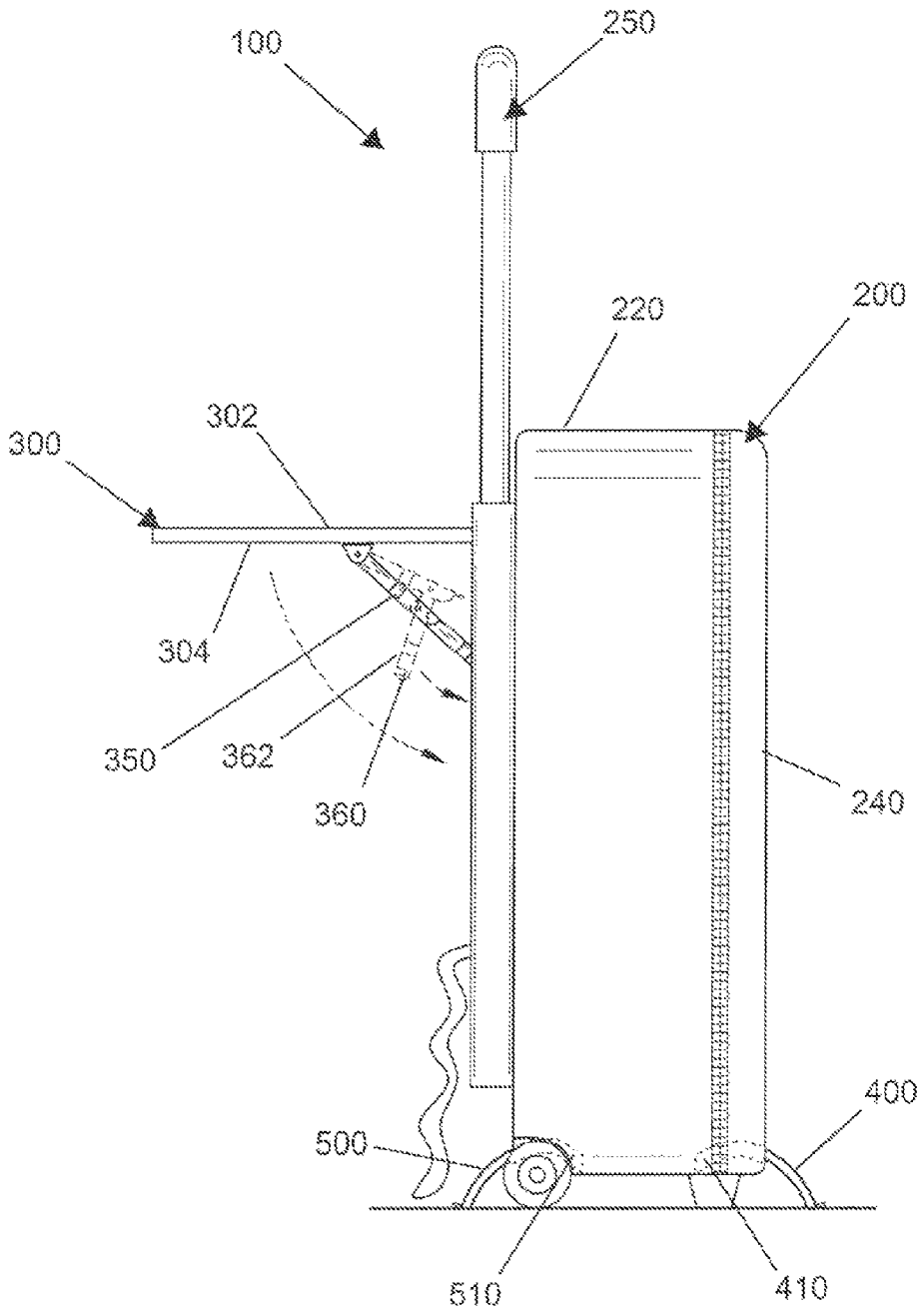
FIG. 19 shows a side view of an alternate embodiment of the present invention.
Figure 20:
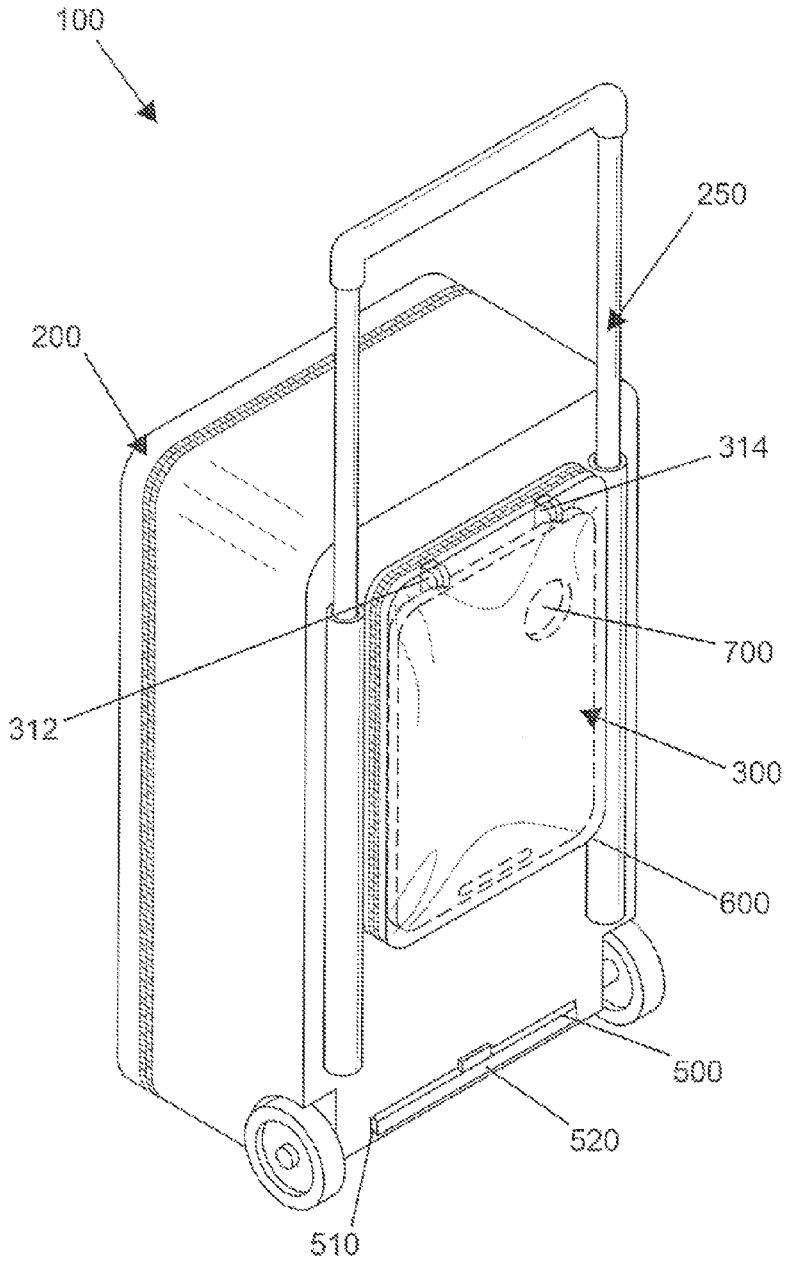
FIG. 20 shows a rear perspective view of an alternate embodiment of the present invention.
Figure 21:
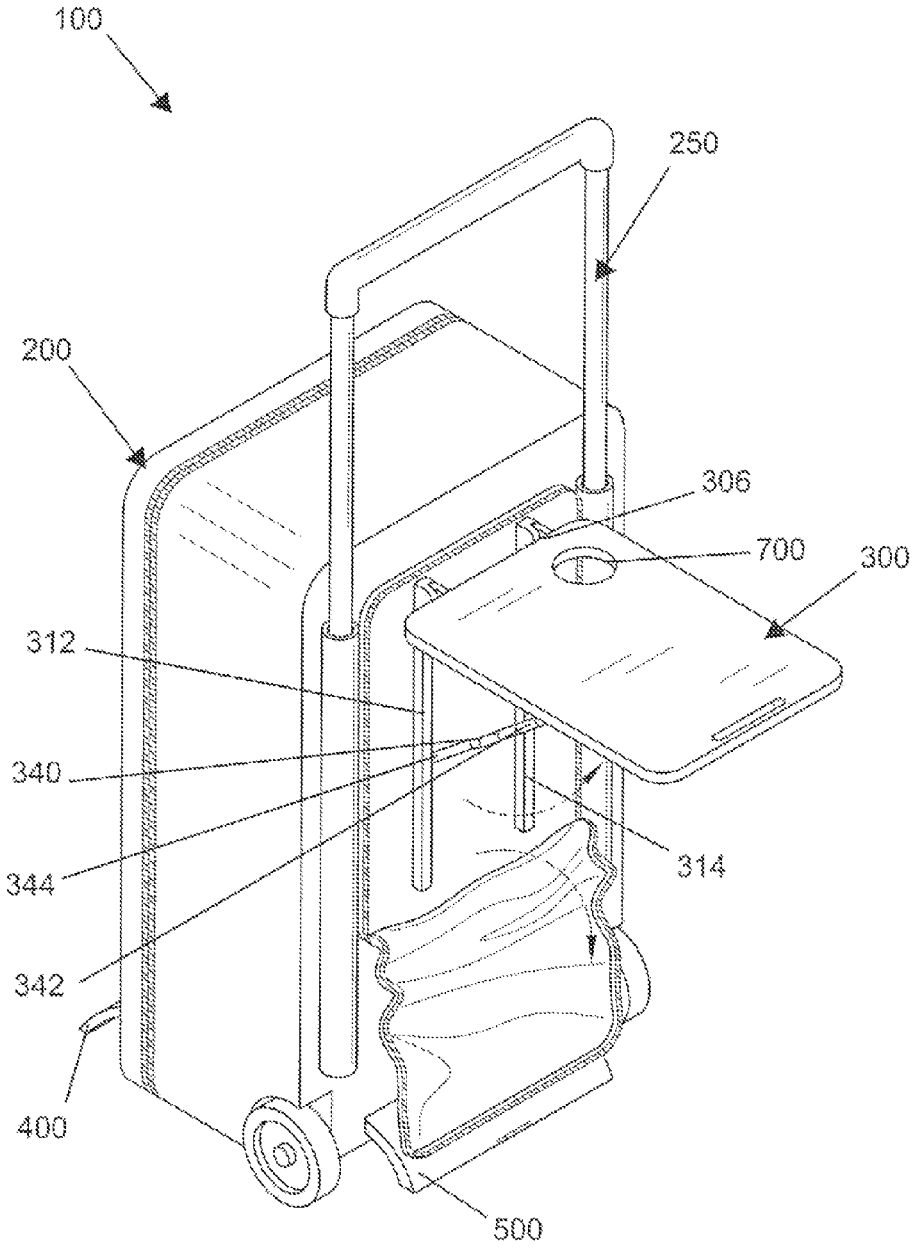
FIG. 21 shows a rear perspective view of an alternate embodiment of the present invention.
Figure 22:
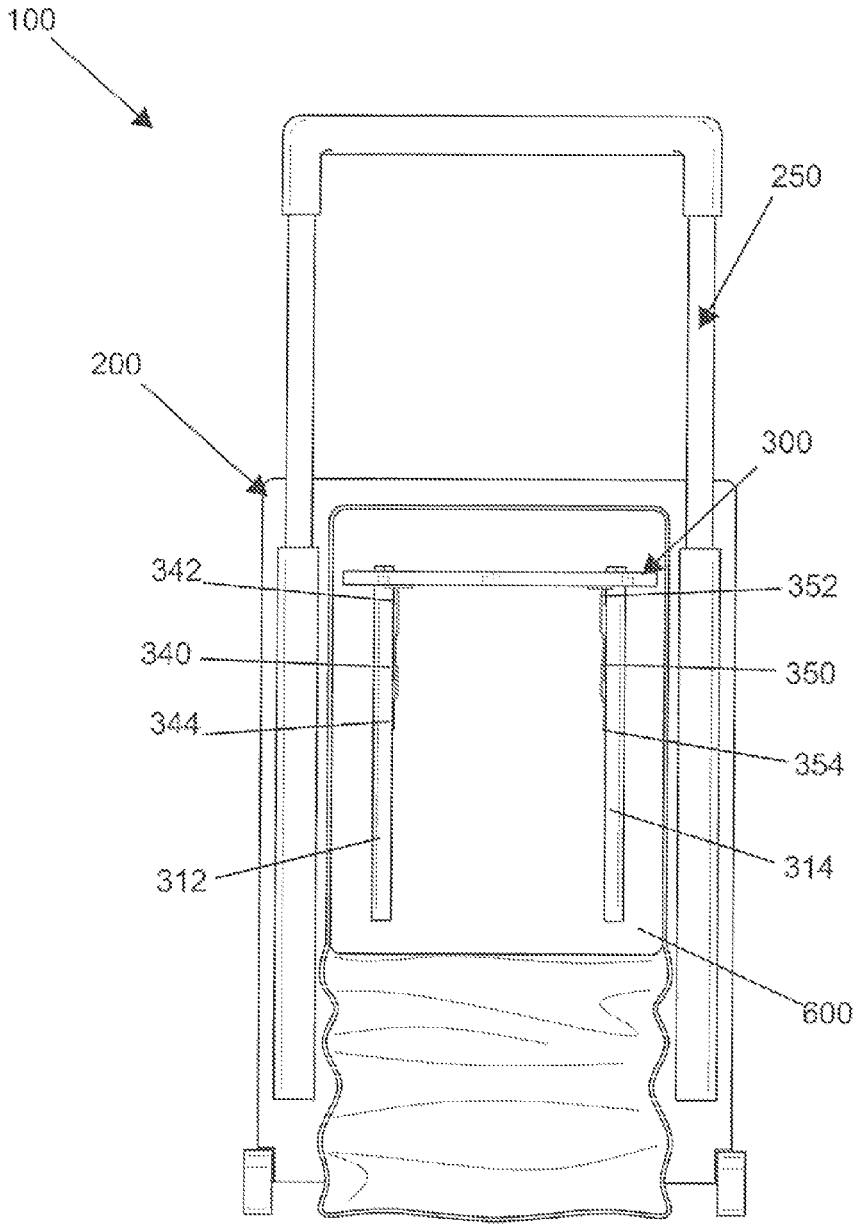
FIG. 22 shows a rear view of an alternate embodiment of the present invention.
Figure 23:
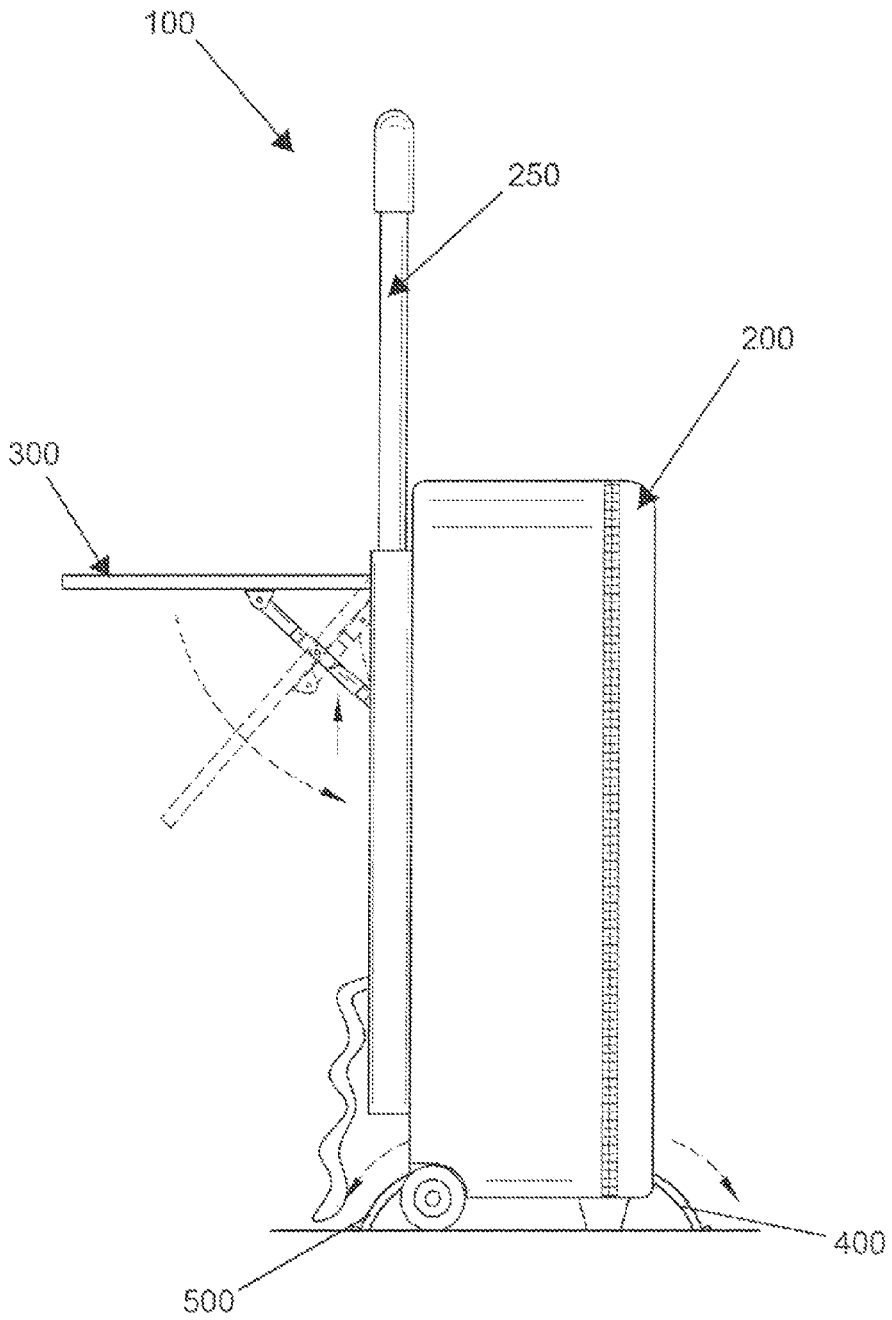
FIG. 23 shows a side view of an alternate embodiment of the present invention.
Figure 24:
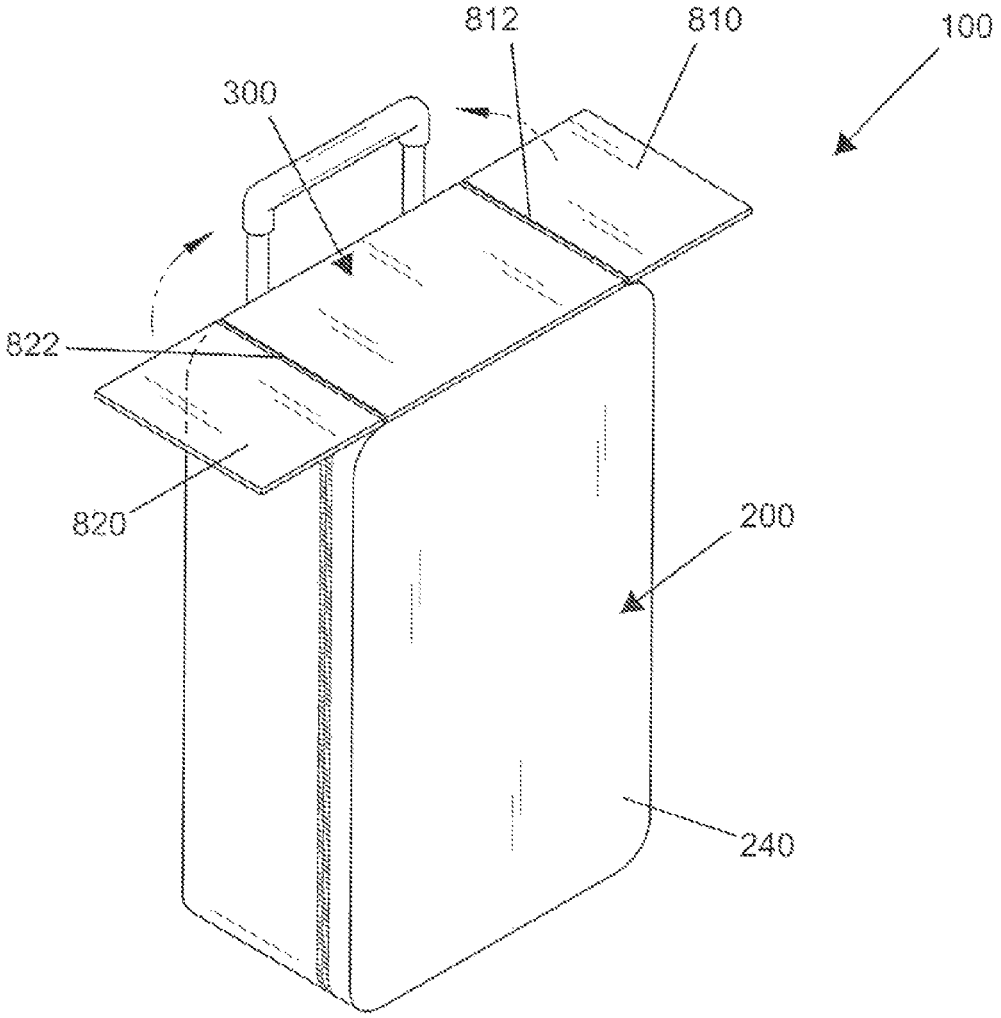
FIG. 24 shows a front perspective view of an alternate embodiment of the present invention.
Figure 25:
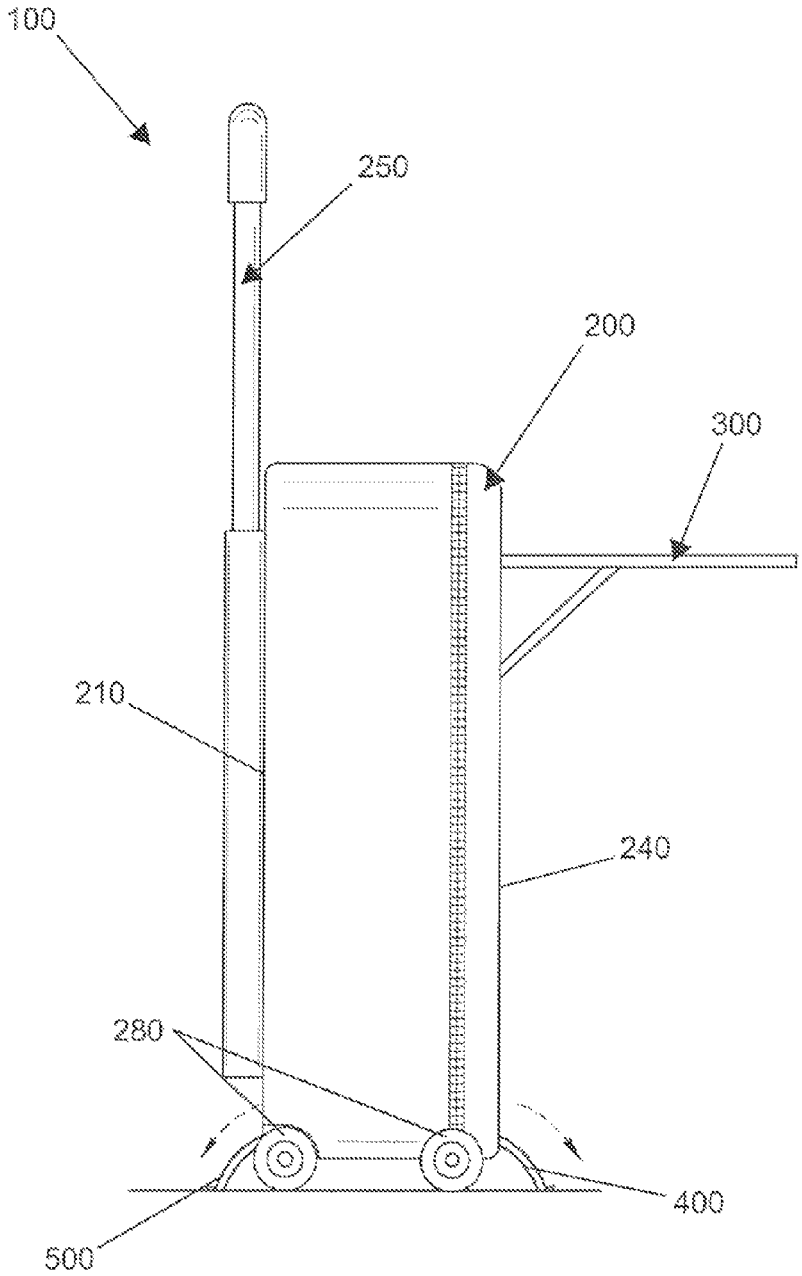
FIG. 25 shows a side view of an alternate embodiment of the present invention.

Referring now to FIG. 16-25, the present invention features a portable suitcase tabletop system (100). In some embodiments, the system (100) comprises a generally hollow suitcase (200) having a generally rigid suitcase rear surface (210), a suitcase top surface (220), a suitcase bottom surface (230), and a suitcase front surface (240). In some embodiments, the suitcase (200) comprises a generally u-shaped unitary telescopic handle (250) having a first handle rod (252), a second handle rod (254), and a top handle rod (256). In some embodiments, the telescopic handle (250) is slidably attached to the suitcase rear surface (210) via a first handle tube (260) and a second handle tube (270). In some embodiments, the top handle rod (256) is located parallel to the suitcase top surface (220). In some embodiments, the suitcase (200) comprises a plurality of wheels (280) located on the suitcase bottom surface (230) close to the suitcase rear surface (210).

In some embodiments, the system (100) comprises a generally planar table (300) having a table top surface (302), a table bottom surface (304), and a table edge (306). In some embodiments, the table (300) is pivotally attached to a generally u-shaped unitary telescopic table mount (310) having a first table mount rod (312), a second table mount rod (314), and a top table mount rod (316). In some embodiments, the first table mount rod (312) is located parallel to the second table mount rod (314). In some embodiments, the top table mount rod (316) is located parallel to the suitcase top surface (220). In some embodiments, the first table mount rod (312) and the second table mount rod (314) are located close to a table edge (306). In some embodiments, the top table mount rod (316) is located at an offset above and away from the table top surface (302) to enable space for gripping by a hand of a user.

In some embodiments, the first table mount rod (312) is slidably located in a first table mount tube (322) and the second table mount rod (314) is slidably located in a second table mount tube (324). In some embodiments, the first table mount tube (322) and the second table mount tube (324) are located on the suitcase rear surface (210) parallel with respect to each other and perpendicular to the suitcase bottom surface (230). In some embodiments, the first table mount tube (322) and the second table mount tube (324) are located on the suitcase front surface (240) parallel with respect to each other and perpendicular to the suitcase bottom surface (230).

In some embodiments, a plurality of horizontal support mount bars (330) are perpendicularly located, each having a support mount bar first end (332) located on an inside surface of the first table mount tube (322) and a support mount bar second end (334) located on an inside surface of the second table mount tube (324).

In some embodiments, a first foldable locking support (340) comprises a first locking support first end (342) pivotally located on the table bottom surface (304) and a first locking support second end (344) having a slot (360) located on a side edge (362) thereon for hooking on the horizontal support mount bar (330). In some embodiments, a second foldable locking support (350) comprises a second locking support first end (352) pivotally located on the table bottom surface (304) and a second locking support second end (354) having a slot (360) located on a side edge (362) thereon for hooking on the horizontal support mount bar (330).

In some embodiments, in a first closed position, the table (300) is located parallel with and pivoted against the suitcase rear surface (210) between the suitcase top surface (220) and the suitcase bottom surface (230). In some embodiments, in a first closed position, the table (300) is located parallel with and pivoted against the suitcase front surface (240) between the suitcase top surface (220) and the suitcase bottom surface (230). In some embodiments, the first table mount rod (312) is telescopically collapsed into a first table mount tube (322) and the second table mount rod (314) is telescopically collapsed into a second table mount tube (324). In some embodiments, a first locking support second end (344) is released from the horizontal support mount bar (330) with the first foldable locking support (340) folded into a retracted position for storage. In some embodiments, a second locking support second end (354) is released from the horizontal support mount bar (330) with the second foldable locking support (350) folded into a retracted position for storage.

In some embodiments, in a second open position, the table (300) is pivoted into a position parallel with the suitcase top surface (220). In some embodiments, the first table mount rod (312) is telescopically extended out from the first table mount tube (322) and the second table mount rod (314) is telescopically extended out from the second table mount tube (324). In some embodiments, the first locking support second end (344) is located on the horizontal support mount bar (330) with the first foldable locking support (340) fully extended and locked into position. In some embodiments, the second locking support second end (354) is located on the horizontal support mount bar (330) with the second foldable locking support (350) fully extended and locked into position.

In some embodiments, the first table mount rod (312) comprises a first spring loaded pin (364) located on a side thereon. In some embodiments, the first spring loaded pin (364) engages one of a plurality of first apertures (366) located on a side of the first table mount tube (322). In some embodiments, the first spring loaded pin (364) is depressed by a user for slidably adjusting the height of the table (300). In some embodiments, the second table mount rod (314) comprises a second spring loaded pin (364) located on a side thereon. In some embodiments, the second spring loaded pin (364) engages one of a plurality of second apertures (366) located on a side of the second table mount tube (324). In some embodiments, the second spring loaded pin (364) is depressed by a user for slidably adjusting the height of the table (300).

In some embodiments, a front support (400) is slidably located in a front support cavity (410). In some embodiments, the front support cavity (410) is located in the suitcase front surface (240) close to the suitcase bottom surface (230). In some embodiments, in a first retracted position, the front support (400) is fully retracted into the front support cavity (410). In some embodiments, in a second extended position, the front support (400) is extended from the front support cavity (410). In some embodiments, the front support (400) locks into the second position, having a front support edge (420) that interfaces with a ground surface. In some embodiments, the front support (400) is for stabilizing the suitcase (200).

In some embodiments, a rear support (500) is slidably located in a rear support cavity (510). In some embodiments, the rear support cavity (510) is located in the suitcase rear surface (210) close to the suitcase bottom surface (230). In some embodiments, in a first retracted position, the rear support (500) is fully retracted into the rear support cavity (510). In some embodiments, in a second extended position, the rear support (500) is extended from the rear support cavity (510). In some embodiments, the rear support (500) locks into the second position having a rear support edge (520) that interfaces with a ground surface. In some embodiments, the rear support (500) is for stabilizing the suitcase (200).

In some embodiments, the suitcase (200) comprises a storage compartment (600) located on the suitcase rear surface (210). In some embodiments, the suitcase (200) comprises a storage compartment (600) located on the suitcase front surface (240). In some embodiments, the storage compartment (600) at least partially contains the table (300).

In some embodiments, the table (300) comprises a cup aperture (700) for receiving a drinking cup.

In some embodiments, a portable suitcase tabletop system (100) comprises a generally hollow suitcase (200) having a generally rigid suitcase rear surface (210), a suitcase top surface (220), a suitcase bottom surface (230), and a suitcase front surface (240). In some embodiments, the suitcase (200) comprises a generally u-shaped telescopic handle (250) having a first handle rod (252), a second handle rod (254), and a top handle rod (256). In some embodiments, the telescopic handle (250) is slidably attached to the suitcase rear surface (210) via a first handle tube (260) and a second handle tube (270). In some embodiments, the top handle rod (256) is located parallel to the suitcase top surface (220). In some embodiments, the suitcase (200) comprises a plurality of wheels (280) located on the suitcase bottom surface (230) close to the suitcase rear surface (210).

In some embodiments, the system (100) comprises a generally planar table (300) having a table top surface (302), a table bottom surface (304), and a table edge (306). In some embodiments, the table (300) is located on the suitcase top surface (220).

In some embodiments, the table (300) comprises a first table panel (810) pivotally located on a table first side (812) and a second table panel (820) pivotally located on a table second side (822).

In some embodiments, a portable suitcase tabletop system (100) comprises a generally hollow suitcase (200) having a generally rigid suitcase rear surface (210), a suitcase top surface (220), a suitcase bottom surface (230), and a suitcase front surface (240). In some embodiments, the suitcase (200) comprises a generally u-shaped telescopic handle (250) having a first handle rod (252), a second handle rod (254), and a top handle rod (256). In some embodiments, the telescopic handle (250) is slidably attached to the suitcase rear surface (210) via a first handle tube (260) and a second handle tube (270). In some embodiments, the top handle rod (256) is located parallel to the suitcase top surface (220). In some embodiments, the suitcase (200) comprises a plurality of wheels (280) located on the suitcase bottom surface (230) close to the suitcase rear surface (210).

In some embodiments, the system comprises a generally planar table (300) having a table top surface (302), a table bottom surface (304), and a table edge (306). In some embodiments, the table (300) is pivotally attached to a first table mount rod (312) and a second table mount rod (314). In some embodiments, the first table mount rod (312) is located parallel to the second table mount rod (314).

In some embodiments, the first table mount rod (312) and the second table mount rod (314) are located close to a table edge (306).

In some embodiments, wherein the first table mount rod (312) and the second table mount rod (314) are located on the suitcase rear surface (210) parallel with respect to each other and perpendicular to the suitcase bottom surface (230).

In some embodiments, a first foldable locking support (340) comprises a first locking support first end (342) pivotally located on the table bottom surface (304) and a first locking support second end (344) located on the first table mount rod (312). In some embodiments, a second foldable locking support (350) comprises a second locking support first end (352) pivotally located on the table bottom surface (304) and a second locking support second end (354) located on the second table mount rod (314).

In some embodiments, in a first closed position, the table (300) is located parallel with and pivoted against the suitcase rear surface (210) between the suitcase top surface (220) and the suitcase bottom surface (230). In some embodiments, in a first closed position, the table (300) is located parallel with and pivoted against the suitcase front surface (240) between the suitcase top surface (220) and the suitcase bottom surface (230). In some embodiments, the first foldable locking support (340) is folded into a retracted position for storage, and the second foldable locking support (350) folded into a retracted position for storage.

In some embodiments, in a second open position, the table (300) is pivoted into a position parallel with the suitcase top surface (220). In some embodiments, the first foldable locking support (340) is fully extended and locked into position and the second locking support second end (354) is fully extended and locked into position.

In some embodiments, the suitcase (200) comprises a plurality of wheels (280) located on the suitcase bottom surface (230) close to the suitcase rear surface (210). In some embodiments, the suitcase (200) comprises a plurality of wheels (280) located on the suitcase bottom surface (230) close to the suitcase rear surface (210). In some embodiments, the suitcase (200) comprises a plurality of wheels (280) located on the suitcase bottom surface (230) close to the suitcase front surface (240).

In some embodiments, the system (100) comprises a tracking chip disposed in the suitcase (200). In some embodiments, the tracking chip is a radio frequency (RF) chip. In some embodiments, the tracking chip is locatable via a tracking unit. In some embodiments, the tracking unit is a mobile phone with a tracking application, a personal computer, a tablet computer, or a stand-alone tracking unit. In some embodiments, the system (100) having the tracking chip is trackable via an individual owner. In some embodiments, the system (100) having the tracking chip is trackable via the airline company or the airport. In some embodiments, the tracking chip is registered in a registry. In some embodiments, suitcases (200) with the tracking chip can be tracked on a plane, in the airport, or globally via the tracking unit to aid an owner of the suitcase (200) in locating it.

In some embodiments, a mobile phone charger is disposed in and integrated into the suitcase (200). In some embodiments, a computer charger is disposed in and integrated into the suitcase. In some embodiments, the mobile phone charger and the computer charger are integrated into a charging station. In some embodiments, the charging station comprises a power supply, for example, a battery and can be used for charging electronic devices when traveling.

In some embodiments, the suitcase (200) is a suitcase, a wheelie, a spinner, a rolling duffle, or a non-rolling bag.

In some embodiments, one or more the compartments are disposed in and integrated into the suitcase (200) for storing paperwork and the like, for example, on the suitcase rear surface (210), the suitcase front surface (240), or a suitcase side surface.

As used herein, the term "about" refers to plus or minus 10% of the referenced number.

The disclosures of the following U.S. Patents are incorporated in their entirety by reference herein: U.S. Pat. No. D 403,899; U.S. Pat. Pub. No. 2010/0236884; U.S. Pat. Pub. No. 2009/0255771; U.S. Pat. Pub. No. 2005/0098402; U.S. Pat. No. 7,114,602; U.S. Pat. No. 6,644,447; U.S. Pat. No. 6,471,019; U.S. Pat. No. 6,105,508; and U.S. Pat. No. 5,437,367.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is clamed is:

1. A portable suitcase tabletop system (100), wherein said system (100) comprises;

(a) a suitcase (200) having a suitcase rear surface (210), a suitcase top surface (220), a suitcase bottom surface (230), and a suitcase front surface (240), wherein the suitcase (200) comprises a generally u-shaped telescopic handle (250) disposed on the suitcase top surface (220), wherein the telescopic handle (250) slidably projects out and away from the suitcase top surface (220) when extended, wherein the suitcase (200) comprises a plurality of wheels (280) disposed on the suitcase bottom surface (230); and (b) a planar table (300) having a table top surface (302), a table bottom surface (304), and a table edge (306), wherein the table (300) is pivotally disposed on the suitcase rear surface (210) or the suitcase front surface (240);

wherein in a first closed position, the table (300) is disposed parallel with and pivoted against the suitcase rear surface (210) or the suitcase front surface (240), wherein in a second open position, the table (300) is pivoted into a position parallel with the suitcase top surface (220);

wherein a U-shaped bar (900) is telescopically disposed on the suitcase rear surface (210) or the suitcase front surface (240) adjacent to the table bottom surface (304), wherein upon retraction, the bar (900) supports the table (300) via interfacing with the table bottom surface (304), wherein the bar (900) extends from the suitcase (200) a distance not greater than a distance from the suitcase rear surface (210) to the suitcase front surface (240), wherein the bar (900) extends out and away from the suitcase rear surface (210) or the suitcase front surface (240) at a bar angle (905), wherein the bar (900) retracts into the suitcase (200), wherein a first bar leg (901) and a second bar leg (902) project into a bar cavity (904) disposed inside the suitcase (200), wherein a bar middle leg (903) remains outside the suitcase (200), wherein the table (300) and the bar (900) are disposed in a zippered pouch (910) disposed on the suitcase rear surface (210) or the suitcase front surface (240), wherein the zippered pouch (910) is adapted to hold one or more additional objects therein;

wherein a telescopic front support (400) is slidably disposed in a front support cavity (410), wherein the front support cavity (410) is disposed in the suitcase rear surface (210) or the suitcase front surface (240) proximal to the suitcase bottom surface (230), wherein in a first retracted position, the front support (400) is fully retracted into the front support cavity (410), wherein in a second extended position, the front support (400) is extended from the front support cavity (410) at a front support angle (405), wherein the front support (400) locks into the second position, having an front support edge (420) that interfaces with a ground surface, wherein the front support (400) is for stabilizing the suitcase (200).

2. The system of claim 1, wherein the system comprises a plurality of telescopic front supports (400) or telescopic rear supports (500) disposed on the suitcase rear surface (210), wherein the telescopic rear support (500) is a telescopic front support (400).

3. The system of claim 1, wherein the system comprises a plurality of telescopic front supports (400) disposed on the suitcase front surface (240).

4. The system of claim 1, wherein the system comprises the telescopic front support (400) disposed on the suitcase front surface (240) and a telescopic rear support (500) disposed on the suitcase rear surface (210).

5. The system (100) of claim 1, wherein the system (100) comprises a first table (300) disposed on the suitcase rear surface (210) and a second table (300) disposed on the suitcase front surface (240).

* * * * *